United States Patent [19]

Bauman

[11] 4,283,192

[45] Aug. 11, 1981

[54] N-SUBSTITUTED SHORT CHAIN CARBOXAMIDES AS ANTISTATIC AGENTS FOR LAUNDERED FABRICS

[75] Inventor: Robert A. Bauman, New Brunswick, N.J.

[73] Assignee: Colgate-Palmolive Company, New York, N.Y.

[21] Appl. No.: 97,467

[22] Filed: Nov. 26, 1979

[51] Int. Cl.[3] ..... D06M 13/40; C11D 3/32; B08B 3/00

[52] U.S. Cl. ..... 8/137; 252/8.8; 252/91; 252/544; 252/174.13

[58] Field of Search ..... 252/8.8, 544, 91, 174.13; 8/137

[56] References Cited

U.S. PATENT DOCUMENTS

| | | | |
|---|---|---|---|
| 2,691,636 | 10/1954 | Stayner | 252/544 |
| 2,702,278 | 2/1955 | Cupery et al. | 252/117 |
| 2,891,912 | 6/1959 | Schwartz | 252/544 |
| 3,231,508 | 1/1966 | Lew | 252/544 |
| 3,250,719 | 5/1966 | Schmolka et al. | 252/529 |
| 3,441,510 | 4/1969 | Campbell | 252/170 |
| 3,654,166 | 4/1972 | Eckert et al. | 252/529 |
| 3,704,228 | 11/1972 | Eckert et al. | 252/548 |
| 4,060,505 | 11/1977 | Ciko | 428/411 |
| 4,069,066 | 1/1978 | Hindle et al. | 252/544 |
| 4,127,512 | 11/1978 | Heyden | 252/544 |

FOREIGN PATENT DOCUMENTS 1259064 1/1972 United Kingdom .

*Primary Examiner*—Joseph L. Schofer
*Assistant Examiner*—Maria Parrish Tungol
*Attorney, Agent, or Firm*—Norman Blumenkopf; Herbert S. Sylvester; Murray M. Grill

[57] ABSTRACT

Short chain acyl derivatives of long chain aliphatic amines useful as non-yellowing antistatic agents for laundered fabrics, detergent compositions containing an effective antistatic amount of said amide and a method of protecting fabrics against acquiring static electricity by contacting fabrics with said composition during laundering. These compounds provide antistatic protection without reducing optical brightener performance of the detergent composition.

12 Claims, No Drawings

N-SUBSTITUTED SHORT CHAIN CARBOXAMIDES AS ANTISTATIC AGENTS FOR LAUNDERED FABRICS

This invention relates to novel antistatic agents and detergent compositions to be used in the laundering of fabrics containing said antistatic agent which is a nitrogen substituted carboxamide having the formula:

RNHCOR' wherein R is a secondary aliphatic hydrocarbon chain of at least 8 carbons, and R' represents an alkyl group containing 1 to 3 carbon atoms or a hydrogen.

DESCRIPTION OF THE PRIOR ART

The use of various and diverse chemical materials and particularly cationic quaternary ammonium compounds as softeners and antistatic agents for textile products is very well known in the art. It is also well known to employ such materials for their antistatic and softening effects during the laundering operation and particularly in the rinse cycle of the laundering process. This technique has been necessitated by the fact that the aforesaid quarternary compounds heretofore employed, being mainly cationic in nature, were not compatible with the anionic detergents, one of the major types of detergents used in the washing cycle.

It is also well known that there is a tendency for laundered articles to yellow or discolor when treated with aforesaid quaternary compounds.

Another disadvantage associated with the use of said cationic agents in the laundering of fabrics therewith is its interference with the deposition on the fabrics of optical brightener, thereby reducing optical brightener performance of a detergent composition containing said optical brightener.

Still another disadvantage of the cationic quaternary ammonium antistatic softeners is its interference with the cleaning properties of the detergent by reducing the soil removal effected by the detergent, resulting in decreased washing effectiveness. The presence of the anionic detergent material substantially negates the fabric softening properties of the cationic quaternary ammonium compounds as well as counteracts the minimal antistatic activity possessed by said quaternary compounds.

Accordingly, higher alkyl hydroxy-acetamides or -butyramides and alkylene oxide reaction products thereof have been found useful in the treatment of fabrics such as in washing compositions, in order to improve foaming of non-ionic detergents, as disclosed in U.S. Pat. No. 3,250,719 to Schmolka et al. Detergent compositions containing higher alkyl polyhydroxylated carboxamides as textile softening agents is also disclosed in U.S. Pat. No. 3,654,166 to Eckert et al. Similarly, fatty amide-alkylene oxide reaction products have also been utilized as textile softening agents for laundered fabrics as disclosed in U.S. Pat. No. 4,060,505 to Ciko.

Similarly, acylation products of polyamines have been used in the treatment of textile materials to provide a permanent softening effect as disclosed in British Pat. No. 1,259,064 to the Henkel and Cie Company; and detergent compositions containing the higher fatty acid monoamide of a hydroxyalkylpolyamine as a textile softener is disclosed in U.S. Pat. No. 3,704,228 by Eckert et al.

Higher and lower alkyl carboxamides of arylamines have utility as a pearling agent in shampoos as disclosed in U.S. Pat. No. 2,891,912 to Schwartz.

The reaction product of a primary straight chain $C_{12}$–$C_{18}$ fatty amine and a $C_{12}$–$C_{18}$ saturated fatty acid has been used to impart desirable foaming characteristics to detergent compositions as disclosed in U.S. Pat. No. 2,691,636 to Stayner. N-dodecylacetamide is also disclosed in U.S. Pat. No. 2,702,278 to Cupery et al for similar effects; and N-methyl hexadecaneamide, N-octadecyloctadecanamide, N-phenyl hexadecanamide, etc. are disclosed as foam suppressants in U.S. Pat. No. 3,231,508 to Lew. The lower alkyl amides are disclosed as detergents in U.S. Pat. No. 3,441,510 to Campbell.

However, none of aforesaid prior art carboxamides or acyl derivatives of long chain aliphatic amines have been found to possess anti-static properties.

SUMMARY OF INVENTION

It has now been discovered that the aliphatic carboxamides of this invention provide antistatic properties and some fabric softening benefits, without causing fabric yellowing, do not interfere with optical brightener action and are compatible with detergents.

Accordingly, it is a primary object of the instant invention to protect fabrics against acquiring static-electrical charge during machine drying subsequent to the laundering.

Another object of the instant invention is to provide such protection in conjunction with conventional detergent compositions during the home laundering process.

A further object of the instant invention is to provide antistatic protection without yellowing and without reducing optical brightener performance.

Still a further object of instant invention is to provide an antistatic composition which may be employed in conjunction with detergents and other cleaning, brightening and laundering additives in a single step laundering operation.

Accordingly, the instant invention relates to antistatic laundering compositions compatible with detergents; and to novel short chain acyl derivatives of long chain aliphatic amines represented by the structural formula:

RNHCOR' wherein R is a secondary aliphatic hydrocarbon chain containing at least 8 carbon atoms and R' is a hydrogen atom Or an alkyl radical containing 1 to 3 carbons; and to the process for imparting antistatic properties to fabrics which consists in treating fabrics with a composition containing a carboxamide substituted in the nitrogen by a secondary long chain aliphatic hydrocarbon. More specifically, antistatic properties are imparted to fabrics by laundering the fabrics in a composition containing a detergent, preferably anionic or non-ionic, the above defined carboxamides, and other ingredients such as phosphate or non-phosphate builders, optical brighteners, enzymes, bleaches, and other conventional additives.

The instant novel carboxamides substituted on the nitrogen atom with one secondary long aliphatic chain containing 8–22 carbon reduces or prevents the generation of static electricity on cotton and synthetic fabrics during laundering. These antistatic properties can be imparted to fabrics by laundering in a detergent composition containing said carboxamides which are completely compatible with anionic, non-ionic, cationic and amphoteric detergents. This same treatment has been found to additionally confer a soft hand on cotton fabrics and to enhance the detergency action of the detergent composition. These beneficial effects are achieved without yellowing or discoloration of the fabrics and without interference with the action of optical brighteners that may be present in the detergent composition.

The carboxamides of the instant invention can generally be prepared by the conventional methods for the acylation of amines, including reaction with carboxylic acids, anhydrides, acid chlorides, esters and ketenes. For example, a solution of a long chain amine in methylene chloride may be treated with equimolar quantities of acyl chloride and triethylamine. The product, isolated as a viscous oil or waxy solid, may be used as is or freed of volatile impurities by heating under vacuum.

More specifically, instant novel carboxamides are prepared from known starting materials by reacting an acyl group such as acetyl- or propionyl- or butyrylchloride or the corresponding anhydride with a primary aliphatic amine containing 8 to 22 carbons wherein the amino functional group is attached to an interior carbon atom of the hydrocarbon chain. Beta amines, manufactured by the Armak Company, which are long chain primary amines, wherein the amino functional group is attached to an interior carbon atom, predominantly at the beta carbon atom, are suitable reactants. Since this reaction is exothermic, cooling may be desirable in order to control the temperature. The reaction is preferably conducted in the presence of any non-reactive organic solvent such as methylene chloride, methyl or ethyl ether, benzene, chloroform or the like, and in the presence of any tertiary amine such as trimethyl amine, pyridine and preferably triethylamine which reacts with the acid byproduct formed during this reaction. The reaction mixture may be washed successively with water, dilute ammonia, dilute acid and water to remove any unreacted starting material, and dried over $Na_2SO_4$ or similar neutral salt. The solvent is removed, preferably by evaporating in vacuum. The resultant carboxamides, which are usually made from mixtures of amines, are liquids, oils or solids.

Another method of preparing the amides of instant invention utilizes the Ritter reaction of converting $\alpha$-olefins containing $C_8$ to $C_{22}$ into internally substituted amides by reacting with acetonitrile (methyl cyanide), propionitrile (ethyl cyanide), or butyronitrile (propyl cyanide) in the presence of a strong acid such as $H_2SO_4$. This reaction may be represented by the following equation:

$$C_{10}H_{21}CH{=}CH_2 + CH_3CN + H_2SO_4 \longrightarrow C_{10}H_{21}\underset{}{\overset{CH_3}{\overset{|}{C}}}HNHCOCH_3, \quad 1.$$

although the product is understood to be a mixture of 2,3,4, etc. substituted isomers. Since this reaction is exothermic, it is desirable to cool said mixture to a temperature of 25°–30° C. and to maintain at said temperature until reaction is complete. The reaction mixture is poured into ice water and neutralized with sodium carbonate and extracted with ether, dried over $Na_2SO_4$ and evaporated in vacuum. This amide reaction product may be purified by distillation.

The formamides may be prepared by the acid catalyzed method of Kraus, Synthesis 361 (1973) by reacting the long chain aliphatic amine with dimethyl formamide. The reaction is initiated by the presence or addition of an acid such as $H_2SO_4$, whereby the temperature rises to about 40°–50° C. and a precipitate is formed. The reaction mixture is heated to about 120°–140° C. with agitation for a sufficient period of time to form the long chain aliphatic formamide (about 2 to 6 hours). The reaction mixture is diluted with water and extracted with ether. Said ether layer is then washed with 5% acid solution such as HCl, dried with $Na_2SO_4$ or similar neutral salt, evaporated in vacuum at about 50° C. to yield the crude formamide which may be further purified by distillation and removing the low boiling fraction therefrom. The resultant formamides are liquids or oils. The reaction proceeds in accordance with the following equation:

$$RNH_2 + (CH_3)_2NCHO + H^+ \rightarrow RNHCHO + (CH_3)_2NH^+ \quad 2.$$

wherein R has the same meaning aforedefined.

The following examples illustrate the manner in which compounds of this invention are prepared, but is not limited thereto.

EXAMPLE 1

Preparation of the N-acetyl derivative of the beta amine, $$CH_3(CH_2)_{12-17}\underset{CH_3}{\underset{|}{C}}HNH_2 : CH_3(CH_2)_{12-17}\underset{CH_3}{\underset{|}{C}}HNHCOCH_3$$

To a solution of 20 g of said beta amine (Armeen L-15 from the Armak Company) and 10 ml triethyl amine in 150 ml methylene chloride was slowly added, with stirring and cooling, 5 ml acetyl chloride. The temperature was maintained below 30° C. during said addition which took 20 minutes. The mixture was stirred for an additional hour and subsequently transferred to a separatory funnel, washed twice with water, once with 14% ammonia and again twice with water, dried over $Na_2SO_4$ and evaporated to an amber oil which crystallized on standing to a waxy solid.

EXAMPLE 2

Preparation of the N-acetyl derivative of the beta amine, $$CH_3(CH_2)_{8-11}\underset{CH_3}{\underset{|}{C}}HNH_2 : CH_3(CH_2)_{8-11}\underset{CH_3}{\underset{|}{C}}HNHCOCH_3$$

To a solution of 14 g of above beta amine (Armeen L-11 from the Armak Company) and 10 ml triethyl amine in 150 ml methylene chloride was slowly added 5 ml acetyl chloride and the amide was prepared in accordance with the procedure of Example 1. 15 g of an amber oil was recovered.

The process described in the above examples may be varied by using other non-reactive organic solvents such as ether, benzene, chloroform, etc; other tertiary amines to react with the acid byproduct such as trimethylamine, pyridine and the like.

EXAMPLE 3

Preparation of the N-formyl derivative of Armeen L-11:

$$CH_3(CH_2)_{8-11}\underset{\underset{CH_3}{|}}{C}HNHCHO$$

To a mixture of 7 g (30 mmoles) Armeen L-11 and 60 ml dimethyl formamide was added 1.5 ml (30 mmoles) concentrated $H_2SO_4$ with agitation. The temperature rose to 50° C. and a precipitate formed. This mixture was heated to a temperature of 130°–140° C. and stirred for 2½ hours. The precipitate gradually disappeared leaving a clear amber liquid which was diluted with 100 ml water and extracted three times with ether. The ether solution was washed with 5% HCl followed by water, dried briefly over $Na_2SO_4$, and then evaporated in vacuum to 4.5 g brown oil. The infrared spectrum had strong amide bands at 3.07, 6.05 and 6.52μ. 3 g of the brown oil was distilled in a Kugelrohr, discarding the fraction boiling at 70°–90° C. (50μ) which eliminated most of the odor. The distillation was continued to obtain 2.5 g lemon yellow oil, b.p. 120°–130° C. (70μ), with a spectrum agreeing with the expected structure.

EXAMPLE 4

Preparation of the N-formyl derivative of Armeen L-15:

$$CH_3(CH_2)_{12-17}\underset{\underset{CH_3}{|}}{C}HNHCHO$$

The procedure of Example 4 was followed using 20 g (60 mmoles) Armeen L-15 in 120 ml dimethylformamide and 3 ml concentrated $H_2SO_4$. The temperature rose to 40° C. and a precipitate formed. The reaction mixture cleared upon heating to 120° C. Heating at 120°–130° C. was continued with agitation for 6 hours. The reaction mixture was diluted with water, extracted with ether and the ether layer treated as in Example 3, yielding 16 g of a red brown oil as the crude formamide. 15.6 g of this crude product was distilled and the fraction boiling at 90°–120° C. showed no amide spectrum, whereas the fraction boiling from 120°–135° C. showed amide peaks as well as unreacted Armeen L-15. The remainder was distilled at 140°–150° C., giving a yield of 9.5 g of the purified L-15 formamide as shown by the infrared spectrum.

EXAMPLE 5

Preparation of N-β-Dodecylacetamide:

$$C_{10}H_{21}\overset{\overset{CH_3}{|}}{C}HNHCOCH_3$$

To 80 g (0.8 mole) 97% sulfuric acid was slowly added over a period of ½ hour with stirring, a mixture of 12 g acetonitrile and 34 g 1-dodecene, the temperature being maintained at 25°–30° C. with an ice-bath. The reaction mixture was stirred and cooled for an additional 2 hours, until no more heat evolved. The reaction mixture was stirred at room temperature for an additional 2½ hours and then poured into 200 ml ice water and allowed to separate in a separatory funnel. The top layer was again poured into 200 ml ice water, neutralized with about 45 g sodium carbonate, extracted with ether, dried over $Na_2SO_4$ and evaporated in vacuum to 39.6 g of a yellow oil. Kugelrohr distillation gave 34 g of N-β-dodecylacetamide boiling at 120°–160° C. (50μ) and having a m.p. of 41°–49° C. Analysis of the end product showed that less than 2% of the product had hydrolyzed to amine.

Other long chain aliphatic primary amines wherein the amino functional group is attached to any inner carbon atom may be used in the preparation of instant acetamide antistatic agents, such as octyl, nonyl, decyl, dodecyl, tetradecyl, hexadecyl, heptadecyl, octadecyl, nonadecyl amine, etc. and mixtures thereof.

Likewise, other α-olefins can be substituted for the 1-dodecene, such as 1-octene, 1-decene, 1-tetradecene, 1-hexadecene, 1-octadecene, 1-eicosene or 1-docosene, and other nitriles can be substituted for the acetonitrile such as propionitrile or butyronitrile.

Similarly, the propionyl, butyryl and formyl derivatives of the corresponding long chain aliphatic amines aforedefined can be prepared by reacting the propionyl chloride or anhydride, butyryl chloride or anhydride, or dialkyl formamide with primary amines where the amine group is in a non-terminal position.

Primary amines where the amino group is attached to the terminal carbons, such as 1-dodecylamine, 1-hexadecylamine, 1-octadecylamine and the like also yield carboxamides with very limited effect on static.

Accordingly, it has been found that the substituent on the nitrogen atom of the carboxyamides effective as antistatic agents is a secondary long aliphatic chain containing 8–22 carbons.

The antistatic compounds of this invention may be used in conjunction with detergents which include anionic detergents such as alkylbenzene-sulfonic acid and its salts, e.g. compounds of the formula alkyl-phenyl-$SO_3$-M, wherein alkyl is an alkyl radical of $C_8$ to $C_{22}$ and preferably $C_{10}$ to $C_{18}$ and M is hydrogen or an alkali metal, which compounds comprise a well-known class of anionic detergents and include sodium dodecylbenzene sulfonate, potassium dodecylbenzenesulfonate, sodium laurylbenzenesulfonate, sodium cetylbenzenesulfonate. Others include paraffin sulfonates, alkyl sulfates, alcohol ether sulfates, olefin sulfonates and the alkylphenolethoxylate sulfates (e.g., sodium dionylphenoxynonaethoxyethanol sulfate, sodium dodecylhexadecaethoxyethanol sulfate), and other equivlent water-soluble salts, particularly of the alkali metal series.

Among the above-noted alkylbenzene-sulfonic acid and salts thereof, the preferred compounds include those which are biodegradable and which are particularly characterized by a linear alkyl substituent of from $C_{10}$ to $C_{22}$ and preferably from $C_{12}$ to $C_{15}$. It is, of course, understood that the carbon chain length represents, in general, an average chain length since the method for producing such products usually employs alkylating reagents of mixed chain length. It is clear, however, that substantially pure olefins as well as alkylating compounds used in other techniques can and do give alkylated benzene sulfonates wherein the alkyl moiety is substantially (i.e., at least 99%) of one chain length, i.e., $C_{12}$, $C_{13}$, $C_{14}$, or $C_{15}$. The linear alkyl benzene sulfonates are further characterized by the position of the benzene ring in the linear alkyl chain, with any of the position isomers (i.e., alpha to omega) being operable and contemplated.

In addition to the benzene sulfonates one may also employ the lower alkyl ($C_1$ to $C_4$) analogs of benzene such as toluene, xylene, the trimethyl benzenes, ethyl benzene, isopropyl benzene and the like. The sulfonates are generlly employed in the water soluble salt form which include as the cation, the alkali metals, ammonium and lower amine, and alkanolamine cations.

Examples of suitable linear alkyl benzene sulfonates include:

sodium n-decyl benzene sulfonate
sodium n-dodecyl benzene sulfonate
sodium n-tetradecyl benzene sulfonate
sodium n-pentadecyl benzene sulfonate
sodium n-hexadecyl benzene sulfonate and the corresponding lower alkyl substituted homologues of benzene as well as the salts of the cations previously referred to. Mixtures of these sulfonates may, of course, also be used with mixtures which may include compounds wherein the linear alkyl chain is smaller or larger than indicated herein provided that the average chain length in the mixture conforms to the specific requirements of $C_{10}$ to $C_{22}$.

The linear paraffin sulfonates are also a well-known group of compounds and include water-soluble salts (alkali metal, amine, alkanolamine, and ammonium) of:

2-decanesulfonic acid
2-dodecanesulfonic acid
2-tridecanesulfonic acid
2-tetradecanesulfonic acid
2-pentadecanesulfonic acid
2-hexadecanesulfonic acid as well as the other position isomers of the sulfonic acid group.

In addition to the paraffin sulfonates illustrated above, others with the general range of $C_{10}$ to $C_{22}$ alkyls may be used, with the most preferable range being from $C_{12}$ to $C_{20}$. The linear alkyl sulfates which are contemplated in this invention comprise the range of $C_{10}$ to $C_{20}$. Specific examples include sodium n-decyl sulfate; sodium n-dodecyl sulfate; sodium n-hexadecyl sulfate; sodium n-heptadecyl sulfate; sodium n-octadecyl sulfate; and the ethoxylated (1 to 100 moles ethylene oxide) derivatives; and, of course, the other water-soluble salt-forming cations mentioned above.

Included in the group of anionic detergents, which have been described above as suitable in the present invention, are the olefin sulfonates, including long chain alkene sulfonates, long chain hydroxyalkane sulfonates, as well as disulfonates. Examples of suitable olefin sulfonates, which are merely illustrative of the general class, are sodium dodecene-1 sulfonate, sodium tetradecene-1 sulfonate, sodium hexadecene-1 sulfonate, and sodium octadecene-1 sulfonate.

Also useful in conjunction with instant antistatic carboxamides are non-ionic detergents which are commercially known, such as alkylaryl polyglycol detergents such as alkylphenol-alkylene oxide and preferably ethylene oxide condensates (2–200 moles ethylene oxide), e.g., p-isooctyl phenol-polyethylene oxide (10 ethylene oxide units), long chain alcohol-ethylene oxide condensation products (2–200 moles ethylene oxide), e.g., dodecyl alcohol-polyethylene oxides having 4 to 16 ethylene oxide units per molecule, polyglycol monolaurate, glycol diolate, sorbitan monolaurate, sorbitan monostearate, sorbitan monopalmitate, sorbitan monooleate, sorbitan sesquioleate, the condensation products of ethylene oxide with sorbitan esters of long chain fatty acids (Tweens), alkylolamides, amine oxides, phosphine oxides, etc.

In addition to the anionic and nonionic detergents which may be employed in conjunction with the antistatic agents of instant invention, cationic, ampholytic, and zwitterionic compounds have also been found to be useful, Representative of those compounds which may be employed in conjunction with the instant fabric antistatic compounds include quaternary ammonium compounds, e.g., distearyl dimethyl ammonium chloride, cetyl trimethyl ammonium bromide, sodium 3-dodecylamino propionate, fatty carbamides, etc.

The composition of the instant invention may also include, in addition to instant antistatic compounds and conventional anionic, cationic, and nonionic detergents, builders, brighteners, hydrotropes, germicides, soil suspending agents, anti-redisposition agents, antioxidants, bleaches, coloring materials (dyes and pigments), perfumes, water-soluble alcohols, foam boosters, non-detergent alkali metal benzene sulfonates, etc.

The builder is, generally, a water-soluble, inorganic salt which may be a neutral salt, e.g., sodium sulfate or an alkaline builder salt such as phosphates, silicates, bicarbonates, carbonates, citrates and borates. The preferred builders are those characterized as condensed phosphates such as polyphosphates and pyrophosphates and alkali citrates. Specific examples of alkaline salts are: tetrasodium pyrophosphate, pentasodium tripolyphosphate (either Phase I or Phase II), sodium hexametaphosphate, and the corresponding potassium salts of these compounds, sodium and potassium silicates, e.g., sodium metasilicate and other silicates (e.g., $Na_2O$; $1.6\text{-}3SiO_2$), sodium carbonate, potassium carbonate and sodium and potassium bicarbonate, sodium citrate and potassium citrate. Other salts may also be used wherein the compounds are water-soluble including the general class of alkali metals, alkaline earth metals, amine, alkanolamine, and ammonium salts. Other builders which are salts of organic acids may also be used, and in particular the water-soluble (alkali metal, ammonium substituted ammonium and amine) salts of aminopolycarboxylic acids such as:

ethylene diamine tetra-acetic acid
nitrilo triacetic acid
diethylene triamine pentaacetic acid
N-(2-hydroxyethyl)-ethylene diamine triacetic acid
2-hydroxyethyl-iminodiacetic acid
1,2-diaminocyclohexane diacetic acid and the like.

Water-insoluble builders having cation-exchange properties may be used also, such as the sodium aluminosilicates, for example Zeolite A, which may be used alone or in combination with other builders such as sodium tripolyphosphates.

In addition to the above ingredients one may as previously delineated employ hydrotropes in connection with the composition of the instant invention. The useful hydrotropes include such compounds as sodium xylene sulfonate, potassium xylene sulfonate, sodium and potassium toluene sulfonates, and the position thereof, ethyl benzene sulfonate, cumene sulfonates, and the like.

In addition to compositions comprising the novel carboxamide antistatic agents of the instant invention in combination with detergent and conventional laundering additives, it is noted that said antistatic agents may in addition be formulated in suitable vehicles for addition to the laundering cycle with the concomitant addition of detergent materials. In connection therewith said amide may be solubilized and/or dispersed by conventional techniques utilizing alcohols, ether alcohols, hydrotropic solutions, glycols, and the like. Furthermore, it is noted that said antistatic agents may also be absorbed onto suitable salts and/or other carriers for addition to the laundering cycle such as, for example, phosphates, borax, silicates, sodium sulfate, clays, starch, and the like. A preferred carrier is a carbonate base bead comprising 49.04 parts sodium bicarbonate, 10.67 parts sodium carbonate, 17.00 parts silicate solids, 0.015 parts xylene red color and 6.00 parts water.

The following Example specifically illustrates a method of dispersing the amides on carbonate base beads. However, it is merely illustrative thereof and it is not limited thereto.

EXAMPLE 6

| Base Bead Composition | |
|---|---|
| Ingredients | Parts |
| $NaHCO_3$ | 49.04 |
| $Na_2CO_3$ | 10.67 |
| Silicate Solids | 17.00 |
| Xylene Red Color | 0.015 |
| $H_2O$ | 6.00 |

67 g of warm bead composition was added to 33 g melted amide of Example 1 on a steam bath and stirred vigorously. The mixture was poured into an evaporating dish and stirred occasionally and then placed in a vacuum oven at room temperature. The liquid was nicely incorporated to give a free-flowing solid.

The amount of amide utilized in connection with detergent compositions is generally considered to be a relatively small proportion as compared to the weight of the active ingredients therein. It is noted, however, that one need only employ an effective amount of said amide which in fact produces the desired antistatic action on fabrics. It is preferred that said amide be present in an amount of from about 2% to about 25%, and preferably 5% to 20%, of the total ingredients present in the detergent composition on a weight basis.

The composition of the instant invention may be employed in either particulate, liquid, tablet, or any other conventional form. Moreover, as noted above, the novel amides as disclosed herein may be employed as antistatic fabric agents by being applied to textile materials during the washing process, with the concomitant addition of detergent materials thereto, or used as a presoak product prior to washing or as a rinse cycle additive after the wash cycle.

The laundering and presoak composition of instant invention will now be illustrated by the following more detailed examples thereof. It is noted, however, that these compositions are merely illustrative and it is not limited thereto.

EXAMPLE 7 a, b, c, d

| Non-phosphate anionic detergent | |
|---|---|
| Ingredient | % |
| Sodium Dodecyl benzenesulfonate | 23 |
| Sodium carbonate | 20 |
| Sodium silicate (1:2.4) | 15 |
| Soap (Sodium Coco-Tallow 80:20) | 2 |
| Nonionic detergent* | 1 |
| Borax | 3 |
| Sodium carboxymethylcellulose | 1 |
| Optical Brightener | .5 |
| Calcined aluminum silicate | 1 |
| Sodium sulfate | 30.5 |
| Water | 3 |

-continued

| Non-phosphate anionic detergent | |
|---|---|
| Ingredient | % |
| | 100.0 |

This composition is spray-dried to produce a powder. To 100 g of this formulation is added 2–10 g amide antistatic amount:

a. N-Propionyl derivative of Armeen L-15 b. $CH_3(CH_2)_{8-11}\underset{\underset{CH_3}{|}}{C}HNHCOCH_3$ (N-acetyl derivative of Armeen L-11)

c. $CH_3(CH_2)_{12-17}\underset{\underset{CH_3}{|}}{C}HNHCOCH_3$ (N-Acetyl derivative of Armeen L-15)

d. N-Formyl derivative of Armeen L-15

*Fatty alcohol ($C_{12-15}$) with average of 7 moles ethylene oxide.

EXAMPLE 8 a, b, c, d

| Phosphate-built Anionic Detergent | |
|---|---|
| Ingredient | % |
| Sodium Tridecyl benzenesulfonate | 15 |
| Nonionic detergent* | .5 |
| Sodium silicate (1:2.4) | 10.5 |
| Sodium tripolyphosphate | 33 |
| Sodium carbonate | 5 |
| Sodium sulfate | 24 |
| Sodium Carboxymethylcellulose | .25 |
| Optical Brighteners | .5 |
| Borax | 1.0 |
| Perfume | .15 |
| Water | 10.1 |
| | 100.0 |

This composition is also spray-dried to produce a powder.

To this composition is added 2–10 g of the amide antistatic agent:

a. N-β-dodecylacetamide of Example 5.

b. $CH_3(CH_2)_{8-11}\underset{\underset{CH_3}{|}}{C}HNHCOCH_3$ c. $CH_3(CH_2)_{12-17}\underset{\underset{CH_3}{|}}{C}HNHCOCH_3$ d. N-Formyl derivative of Armeen L-15

*Fatty alcohol ($C_{12-15}$) condensed with average of 7 moles ethylene oxide.

EXAMPLE 9 a, b, c, d

| Built Nonionic Detergent | |
|---|---|
| Ingredient | % |
| Ethoxylated alcohol* | 19 |
| Sodium tripolyphosphate | 60 |
| Sodium silicate (1:2.4) | 10 |
| Optical Brighteners | 2 |
| Enzyme (Proteolytic) | 1.5 |
| Perfume and Color | 0.35 |
| Moisture | 7.15 |
| | 100.00 |

To 40 g of this formulation which is in the form of a powder, is added 2–10 g of fabric antistatic agent:

a. N-tetradecyl internally substituted acetamide.

-continued b. $CH_3(CH_2)_{8-11}CH(CH_3)NHCOCH_3$ c. $CH_3(CH_2)_{12-17}CH(CH_3)NHCOCH_3$ d. N-hexadecyl internally substituted acetamide.

*Fatty alcohol ($C_{12-13}$) condensed with an average of 6.5 moles ethylene oxide.

EXAMPLE 10

| Ingredient | Presoak Product % |
|---|---|
| Sodium Linear tridodecylbenzene sulfonate | 6.3 |
| Sodium silicate | 8.3 |
| Sodium tripolyphosphate | 41.7 |
| Sodium sulfate | 35.4 |
| Water | 8.3 |

6 g N-Acetyl derivative of Armeen L-15 and 48 g of the above presoak formulation were added to a GE washer at 120° F. and agitated to dissolve. Swatches of 4 fabrics cotton terry, dacron, nylon and dacron/cotton were added, agitated for 1 minute and let soak overnight. In the morning, the water was spun out and 100 g of a phosphate-built anionic detergent was run through the resular was cycle at 120° F. Another run was made with the L-15 acetyl derivative added to the detergent and the presoak formulation added to the washer, and a control was run with the detergent and presoak product alone. The results given in Table I, clearly show the antistatic activity of instant amides in presoak formulations as well as in detergent compositions.

TABLE I

| Material | Static (1) | Softness (2) |
|---|---|---|
| L-15 acetyl derivative, presoak | 2.0 kV | 1− |
| L-15 acetyl derivative, no presoak | 2.2 | 4 |
| Control | 22 | 1 |

(1) Sum of the absolute values of surface charges of the 4 fabrics on removal from the dryer.
(2) Subjective reading on a scale of 1 to 10; higher values are softer.

The presence of the L-15 acetyl derivative showed no effect on the detergency of the composition as well as insignificant yellowing and brightener effects.

Utility of the amides in reducing static electricity without yellowing or depressing brightening was shown in a test run in GE washers (18 gal. water) at 120° F. with a mixed clean fabric load (cotton terry, dacron double knit, Banlon nylon, dacron/cotton 65/35) and soiled swatches (Test Fabrics nylon, Test Fabrics cotton, Scientific Services clay on cotton, Scientific Services clay on dacron/cotton, EMPA cloth), and tumble dried for 45 minutes. In each case 3 g of the test material was added to the washer simultaneously with 40 g of the formulation of Example 9 or as indicated.

TABLE II

| Amide | Static Value | Softness |
|---|---|---|
| 1. None | 12.7 kV | 1 |
| 2. L-11 acetyl derivative | 1.0 | 1 |
| 3. L-15 acetyl derivative | 1.2 | 1 |
| 4. 10 g base beads of Example 6 with no amide | 14.8 | 1 |
| 5. 5 g L-15 acetyl derivative* | 1.2 | 6 |
| 6. 5 g $C_{12}$ Acetamide* i.s. | 1.2 | 3 |

TABLE II-continued

| Amide | Static Value | Softness |
|---|---|---|
| 7. 5 g $C_{14}$ Acetamide* i.s. | 1.1 | 8 |
| 8. 5 g $C_{20}$ Acetamide* i.s. | 4.2 | 6 |
| 9. 5 g $C_{22}$ Acetamide* i.s. | 5.5 | 4 |

*The amide is dispersed on 10 g of the base beads as shown in Example 6.
i.s. internally substituted.

Using concentrations from 7.5 to 240 ppm, the compounds of this invention were found to have no significant effect on overall detergency of the soiled swatches, to cause no loss in brightener efficiency, and to cause no significant yellowing of nylon or cotton in contrast to an equal weight of a quaternary ammonium type antistatic agent which was deficient in all these areas. The reduction in static electricity on the tumble dried fabrics was found to be concentration dependent with over 90% effectiveness at levels of 60 ppm or more in contrast to an average reduction of 30% for the quaternary which did not improve with increasing concentration.

Comparative results with amides, not embraced by instant invention, show their inability to reduce static electricity generated during the washing and drying of mixed fabric loads.

Table III utilizes 5 g of amide with 40 g of the built non-ionic detergent of Example 9 or as indicated.

TABLE III

| Composition | Amide | Softness | Static value |
|---|---|---|---|
| 1. Example 9 | — | 1 | 27.1 |
| 2. Example 9 | L-15 acetyl derivative | 5 | 0.3 |
| 2a. Example 9 + 125 ml Clorox* | L-15 acetyl derivative | 10 | 0.2 |
| 3. Example 9 | $C_{12}$ acetamide i.s. | 1 | 0.45 |
| 4. Example 9 | $C_{16}$ acetamide i.s. | 1 | 3.8 |
| 5. Example 9 | $C_{18}$ acetamide i.s. | 1 | 1.9 |
| 6. Example 9 | L-15 formyl derivative | 8 | 1.0 |
| 7. Example 9 | L-15 propionyl derivative | 3 | 4.4 |
| 8. Example 8 (100 g) | L-15 propionyl derivative | 1 | 3.8 |
| 9. Example 8 (100 g) | L-15 acetyl derivative | 8 | 1.4 |
| 10. Example 7 (100 g) | — | 1 | 30.5 |
| 11. Example 7 (100 g) | L-15 acetyl derivative | 2 | 0.3 |
| 12. Example 7 (100 g) | N-cocoalkyl acetamide | 8 | 12.5 |
| 13. Example 8 (100 g) | N-cocoalkyl acetamide | 5 | 13.1 |

i.s. internally substituted.
*chlorine bleach added 2 minutes after start of wash cycle.

The ability of the internally substituted carboxamides to reduce static electricity in the presence of both anionic and non-ionic detergents, either phosphate-built or non-phosphate, is clearly shown with Compositions 2–9 and 11.

However, the terminally substituted amides exemplified by the cocoalkyl acetamide is relatively ineffective as an antistatic agent in most detergents as shown by Compositions 12 and 13. Detergency of the non-phosphate compositions is also decreased due to the presence of said cocoalkyl acetamides, whereas detergency of compositions containing the internally substituted amides is not decreased.

The addition of bleach during the wash cycle does not affect the static suppression properties of the amides of instant invention as specifically shown by Composition 2*a*, nor is there any interference by these antistatic agents with the bleaching action.

In connection with the subject compositions, it is noted that in built detergents, the organic cleaning agent, i.e., the anionic, nonionic, etc., compound may comprise from about 5% to upwards of 75% by weight of the total formulation and usually varies from 5% to 35% by weight. In liquid compositions, the amount of water used is relatively high in order to obtain pourable and generally stable systems. In these, total solids may vary from a few percent, i.e., 2–10%, upwards of about 50–60% with the organic detergent present, usually in amounts from about 2–25% and preferably 5–15%. In solid formulation, i.e., powder, etc., total solids may run as high as 90% or more and here the organic detergent may be used at the high concentrations above indicated, but usually the range is 5–25%. The second major component of the built or heavy duty liquids, and this is true of the solid (i.e., powdered or tableted types) formulations also, is the alkaline builder salt, and the amount thereof again may vary considerably, e.g., from 5–75% of the total composition. In solid formulations, larger percentages are generally employed, e.g., 15–50%, whereas in the liquid types, the salts are used in lesser amounts, e.g., 5–25% by weight of the total composition.

It is understood that the foregoing detailed description is given merely by way of illustration and that variations may be made therein without departing from the spirit of the invention. The "Abstract" given above is merely for the convenience of technical searchers and is not to be given any weight with respect to the scope of the invention.

I claim:

1. An antistatic composition for laundering fabrics comprising about 2–25% by weight of a carboxamide antistatic agent substituted on the nitrogen atom and having the formula:

RNHCOR' wherein R is a secondary aliphatic hydrocarbon chain containing at least 8 carbons and R' is a hydrogen or an alkyl group containing 1–3 carbons, and a detergent selected from the group consisting of anionic, nonionic, cationic, ampholytic and zwitterionic detergent materials.

2. An antistatic composition for laundering fabrics comprising about 2–25% by weight of the amide antistatic agent defined in claim 7, and a nonionic detergent.

3. The composition of claim 2, additionally comprising optical brighteners and builders.

4. The composition of claim 1, wherein the detergent is anionic and the antistatic agent constitutes about 2–25% by weight of the composition.

5. The composition of claim 4, additionally comprising optical brighteners and builders.

6. The composition of claim 1, wherein the amide antistatic agent is absorbed on a carbonate base bead carrier comprising sodium bicarbonate, sodium carbonate and silicate solids.

7. A method of protecting fabrics against acquiring static electricity during the laundering process comprising contacting fabrics with the composition of claim 1.

8. A process of imparting antistatic properties to fabrics which consists in treating fabrics with a composition containing an antistatic amount of the compound defined in claim 7.

9. The method of claim 8, which consists in laundering the fabrics in a composition comprising a detergent and the antistatic compound defined in claim 1.

10. The method of claim 8, wherein the antistatic agent is added during the rinse cycle after the wash cycle.

11. The method of claim 8, wherein the antistatic agent is added to a presoak composition prior to the wash cycle.

12. The method of claim 8, wherein the antistatic agent is added during the wash cycle.

* * * * *